United States Patent [19]

Thonnes et al.

[11] 4,129,022

[45] Dec. 12, 1978

[54] PIERCING A SOLID BILLET

[75] Inventors: Horst Thönnes; Joachim Wünsche, both of Remscheid, Fed. Rep. of Germany

[73] Assignee: Mannesmann Aktiengesellschaft, Dusseldorf, Fed. Rep. of Germany

[21] Appl. No.: 819,494

[22] Filed: Jul. 27, 1977

[30] Foreign Application Priority Data

Aug. 3, 1976 [DE] Fed. Rep. of Germany ..... 2635342

[51] Int. Cl.[2] ..... B21C 23/32; B21D 37/18

[52] U.S. Cl. ..... 72/41; 72/267

[58] Field of Search ..... 29/DIG. 47; 72/41, 42, 72/208, 209, 267, 325

[56] References Cited

U.S. PATENT DOCUMENTS

| | | | |
|---|---|---|---|
| 2,261,304 | 11/1941 | Sparks | 29/DIG. 47 |
| 2,791,924 | 5/1957 | Sawyer | 72/42 |
| 2,956,337 | 10/1960 | Buffet et al. | 72/41 |
| 3,777,528 | 12/1973 | Sirantoine | 72/41 |
| 3,818,733 | 6/1974 | Cauley et al. | 72/41 |

FOREIGN PATENT DOCUMENTS

| | | | |
|---|---|---|---|
| 160462 | 11/1952 | Australia | 72/41 |
| 420447 | 4/1947 | Italy | 72/267 |
| 523736 | 4/1955 | Italy | 72/325 |

*Primary Examiner*—E. M. Combs

*Attorney, Agent, or Firm*—Smyth, Pavitt, Siegemund, Jones & Martella

[57] ABSTRACT

An initial well is formed into the rear end of a cylindrical billet thereby providing a centering collar. The billet is additionally centered at the receiver bottom and pierced by a frustoconical mandrel under retention of the well.

7 Claims, 4 Drawing Figures

1
2
3
4
5
6
7
8
9
10

PIERCING A SOLID BILLET

BACKGROUND OF THE INVENTION

The present invention relates to piercing a solid, cylindrical, metallic billet.

Piercing of such billets usually is carried out in a suitable piercing and press tool. In an initial phase, and as a preparatory step, an initial indent, perforation, blind bore or well is provided to be filled with lubricant for the piercing mandrel. Aside thereform, piercing of a billet is carried out by drilling a bore at first, and a conical mandrel widens the opening. Alternatively, a somewhat blunted piercing mandrel is being driven into the billet for one step piercing.

Predrilling followed by driving a concical mandrel into the drilled bore requires comparatively low press forces as to the mandrel operation, but the drilling is an additional step. This particular method is used today for piercing steel or steel alloy billets.

The use of a blunt mandrel refers to an older method but requires the use of a press exerting sufficiently large forces, that is very large, press forces upon the billet. Moreover, it was found that this particular method is not too reliable as far as centering of the pierced aperture or bore in relation to the outer periphery of the billet is concerned.

DESCRIPTION OF THE INVENTION

It is an object of the present invention to improve warm piercing of a billet in a single working step.

It is a particular object of the present invention to improve the piercing process of billets so that the required press forces remain relatively low, but still avoid the formation of an eccentric bore.

It is a particular object of the present invention to provide a piercing method which can be carried out by means of press working machines which are designed generally for widening blanks or billets and which will require very little modification as far as overall construction and operation is concerned.

In accordance with the preferred embodiment of the present invention, it is suggested to provide the front end of the solid cylindrical metal billet to be pierced with a callotta or conical indent constituting a well to be filled with lubricant. Thereafter, the billet is placed into a cylindrical receiver and pierced by means of a mandrel, which has a truncated-conical configuration with a small diameter front end being flat or convex, but the convexity is less pronounced than the concave contour of the well, so that the mandrel does not force the lubricant out of the well, initially as well as during the piercing process.

The invention is based on the discovery that on one hand, a frustoconical piercing mandrel requires relatively low power for piercing solid billets, while on the other hand, a flow impeded zone is established immediately in front of the piercing mandrel, so that the lubricant can actually be retained in a well that is, so to speak, shifted ahead of the mandrel, deeper into the billet and continues to dispense lubricant throughout the piercing process.

A cylindrical mandrel, possibly even one with a concave front face will not ensure reliable lubrication during the piercing process. On the other hand, the particular truncated or frustoconical piercing mandrel in accordance with the inventive suggestion, establishes a gradual flow of the lubricant out of the flow impeded zone of the billet and along the outer surface of the mandrel.

The initial formation of a well is also instrumental for centering the piercing process in reference to the mandrel and the periphery of the billet. The initial opening and well is preferably formed by a material-flow-producing process such as upsetting the front end of the billet and widening it to form a collar. That particular collar permits self-centering of the billet in the cylindrical receiver of the piercing press.

In the past, the necessary spacing between billet and receiver opening was a source for the production of an eccentric bore by the piercing process. This particular eccentricity was usually avoided through axial upsetting of the billet; that upsetting required exertion of rather large press forces.

The inventive method avoids the need for that axial upsetting and permits combining the formation of the initial well with the generation of a centering collar. However, it may be of advantage to provide at first an indent well through cutting, and this opening is widened subsequently by the piercing mandrel to obtain the centering collar.

In furtherance of the invention, it is suggested to center the billet in addition by choosing a receiver with a cylindrical cavity which, at its lower end, reduces slightly in diameter, the diameter reduction being preferably about equal to a value that is twice the diameter difference between the billet and receiver in the main part, and the length of that diameter reduced receiver portion of the cavity may run from about half to twice the diameter of the piercing mandrel. This way, the billet will be pushed against the bottom shear plate of the receiver cavity only after piercing has begun. The billet having smaller diameter than the main part of the receiver cavity will not laterally tilt but remains doubly centered through the upper collar and the lower reduced diameter portion of the receiver, and this centering position is maintained throughout the piercing operation.

DESCRIPTION OF THE DRAWINGS

While the specification concludes with claims particularly pointing out and distinctly claiming the subject matter which is regarded as the invention, it is believed that the invention, the objects and features of the invention and furhter objects, features and advantages thereof will be better understood from the following description taken in connection with the accompanying drawings in which:

FIGS. 2, 3 and 4 all show sections through a billet with receiver, and a mandrel in different positions.

Proceeding now to the detailed description of the drawings, FIG. 1 shows a cylindrical, metal billet 1 being of solid configuration and having received an initial indent, blind bore or aperture for establishing a well receiving lubricant 4. This blind bore, opening or well 2 is of calotta-shaped or conical configuration with a rounded bottom. The well 2 has been made by means of a process that may or may not involve cutting but hole punching resulting in a displacement flow of the material. Consequently, the blank or billet has been provided thereby with a thickened or wider collar portion 3.

Figures 1, 2, 3, 4:
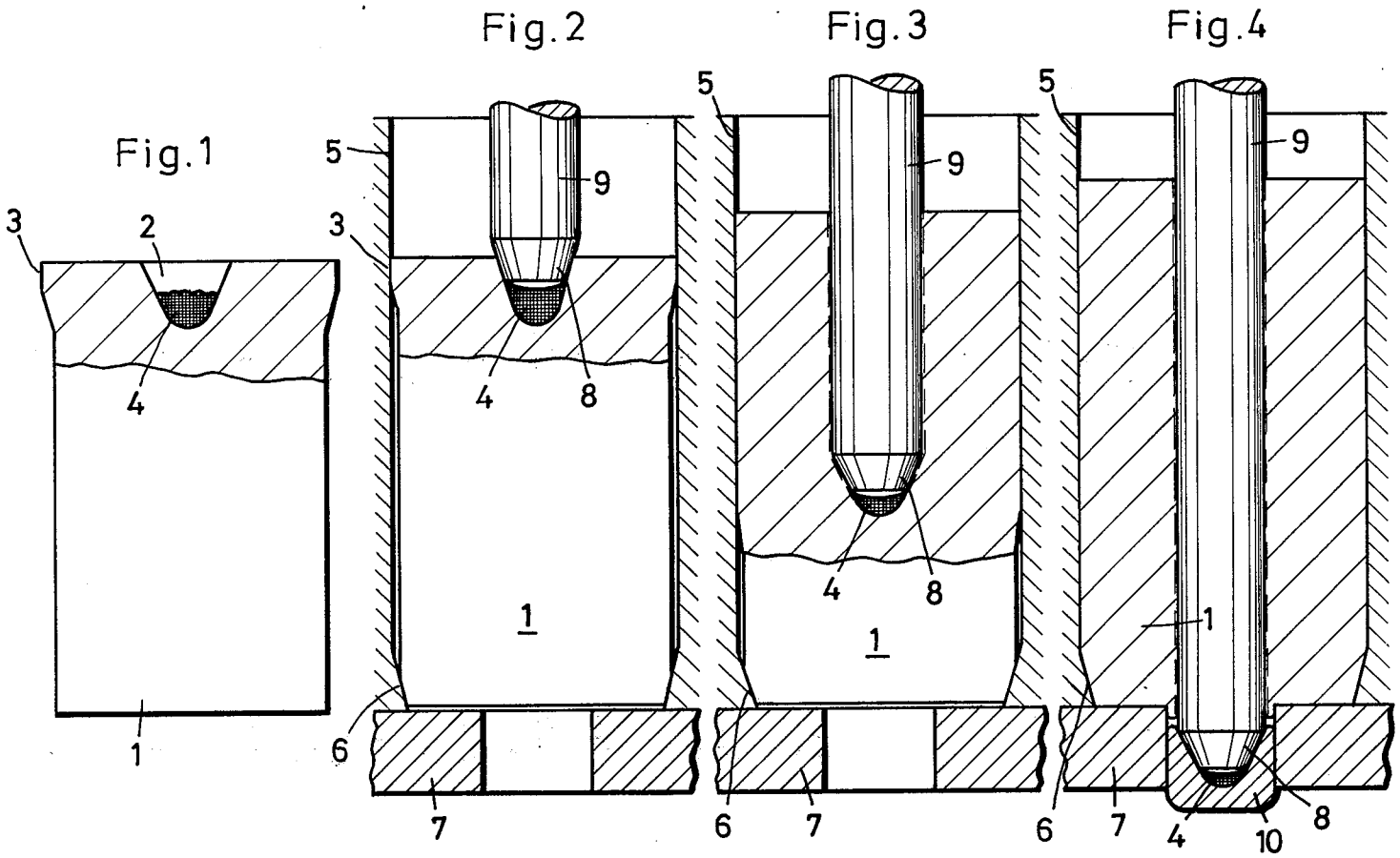
FIG. 1 is a side view partially in section of a billet or blank as prepared for piercing in accordance with the present invention.
FIG. 2 shows an initial phase of piercing.
FIG. 3 shows about the half-way point of the piercing process.
FIG. 4 shows the disposition of the piercing mandrel at the end of the piercing process.

The initial punching is carried out outside of the receiving die of the piercing press so that the collar portion 3 can be developed without impediment. The diameter of collar portion 3 should not be larger than the inner diameter of the receiving die. This way, the cylindrical periphery of collar 3 becomes a first centering surface for positioning the billet in relation to the piercing mandrel.

The thus prepared billet 1, as per FIG. 1, will be placed into a receiver 5 as shown in FIG. 2. The receiver die 5 has an interior die opening or receiver cavity which is almost cylindrical. The deviation amounts to about 1% from a cylindrical contour, to permit easier removal of the pierced billet following the piercing process. The lower portion of the die is provided with a conical throat portion 6, which is sufficiently pronounced so that the blank will be seated on that throat portion 6 thereby defining a second centering surface.

The billet as a whole is, for the most part, not in engagement with the die but leaves a small gap in-between. The diameter reduction at throat 6 amounts to about twice the difference between the inner diameter of the cylindrical receiver cavity and the outer diameter of the unpierced billet 1. The axial length of the throat is comparable with the diameter of the mandrel (8, 9). That axial length should be in the range from about half to about twice the (largest) mandrel diameter.

A shear plate 7 closes off the bottom of the die. The plate 7 has an opening through which the mandrel can push excess material. The assembly as a whole is mounted in the frame or stand of the press tool. That press may basically be of the type used for flaring or other widening operations.

The piercing mandrel 8 is of frustoconical configuration and is disposed on a mandrel rod 9 which, in turn, bears against a traverse being part of the ram or punch drive and holding structure of the press. FIG. 2 shows specifically the initial disposition of the mandrel 8 as inserted into the opening 2. The billet 1 is forced towards the shear plate 2 but is not upset at this point.

It should be mentioned that the usual upsetting of the billet by means of an annular plunger acting upon the billet with a large compression force, is avoided by the equipment in accordance with the invention. The piercing mandrel 8 has the configuration of a truncated cone and resembles to some extent the piercing mandrels as used in tube rolling. However, the front end of the piercing mandrel 8, being the end of the truncated cone of smallest diameter, is either flat or of convex, i.e., of slightly outwardly bulging contour (it is not concave).

Either by design of the tooling or following forced insertion of mandrel 8 into the well 2, the sides of the well snugly abut the conical contour of the mandrel. However, the conically or calotta-shaped well 2 continues downwardly because of its rounded bottom, while the flat or only slightly convex mandrel tip does not displace the lubricant in the well. As the piercing begins, this configuration does not change and is actually being maintained throughout the piercing process. The mandrel causes the material to flow radially outwardly while the downwardly directed force of the piercing mandrel causes the billet material in front to be shifted down, thereby, shifting, so to speak, the well down and deeper into the billet to remain a reservoir for lubricant throughout the piercing process.

The flow conditions are such that the billet material seeks to displace the lubricant but because of the very high compression force as exerted by the material upon the cone of the mandrel and vice versa, such a displacement is, in fact, avoided, at least to a sufficiently high degree so that, in fact, the well as such is being retained throughout the piercing process.

FIG. 3 shows an intermediate stage and progress of the piercing process. The mandrel, as it is being forced into the billet, widens it and pushes the outer peripheral towards the wall of the cavity of the receiver 5 but without relative displacement of the billet as a whole in relation to the centering surfaces 3 and 6.

As was outlined in the introduction, the avoiding of the formation of an eccentric bore in the billet as pierced is one of the primary objects of the invention. A source for such an eccentricity was the inevitable gap between the billet and the bore of the receiving die. In the past, one attempted to avoid eccentric piercing by axial upsetting of the billet requiring relatively high press forces. Now, in accordance with the method and equipment as described, the billet centers itself in the receiver and remains centered throughout on account of the initial centering, specifically by the two-fold centering as described which insures concentricity of the bore as made in relation to both, the initial diameter and the final outer diameter, and cylindrical contour of the billet when pierced.

The shear plate 7 has on opening through which a path of excess material 10 is pushed out at the end of the piercing process, and as shown in FIG. 4. That, in fact, completes the piercing process; the rod 9 will be retracted and the pierced billet will be ejected from the side that is covered by the shear plate 7. The billet is now ready for use in another process and for further working.

The invention is not limited to the embodiments described above but all changes and modifications thereof not constituting departures from the spirit and scope of the invention are intended to be included.

We claim:

1. Method of completely piercing a solid, unpierced, cylindrical, metal billet, comprising the steps of:

forming an initial well into one axial front end of the billet, the well having a curved bottom merging with a conical surface;

filling the well at least partially with lubricant;

placing the billet into a cylindrical receiver; and inserting a piercing mandrel into said well, said mandrel having a configuration of a truncated cone with a flat or slightly convex front end having a lesser curvature than the curved bottom of the well which partially but not completely fills the well upon being inserted into the well and engages the well's conical surface, and piercing the billet by forcing said mandrel completely through the billet by causing the conical configuration of the mandrel to move the conical surface of the well deeper into the billet without direct engagement of the bottom of the well by the mandrel front, thereby leaving a portion of the well filled with lubricant throughout the piercing until completed.

2. The method as in claim 1, which further includes the step of forming a peripheral collar at said front end of the billet which is wider than the remaining length of the billet for centering the billet in the receiver.

3. The method as in claim 2, said collar being formed by metal deformation simultaneously with the forming of the well the well.

4. The method as in claim 2, wherein the well is formed by cutting, the forming of the collar being effected by forcing the mandrel into the well.

5. The method as in claim 1, and including the step of using a receiver with a cylindrical cavity and having a wider diameter than the diameter of the billet as inserted into the receiver, except for a lower portion of the receiver in which the cavity diameter is radially reduced in diameter, and is less than the diameter of the inserted billet.

6. The method as in claim 5, said radial reduction having a length in the receiver of about half to twice the diameter of the mandrel.

7. The method as in claim 6, said length of said radial reduction being about twice the difference between the inner diameter of the receiver cavity above the reduced portion, and the outer diameter of the billet.

* * * * *